US012507856B2

(12) United States Patent
Brugora

(10) Patent No.: US 12,507,856 B2
(45) Date of Patent: Dec. 30, 2025

(54) CLEANING DEVICE

(71) Applicant: Carl Freudenberg KG, Weinheim (DE)

(72) Inventor: Alessandro Brugora, Cernusco sul Naviglio (IT)

(73) Assignee: CARL FREUDENBERG KG, Weinheim (DE)

( * ) Notice: Subject to any disclaimer, the term of this patent is extended or adjusted under 35 U.S.C. 154(b) by 326 days.

(21) Appl. No.: 18/041,216

(22) PCT Filed: Jul. 1, 2021

(86) PCT No.: PCT/EP2021/068163
§ 371 (c)(1),
(2) Date: Feb. 10, 2023

(87) PCT Pub. No.: WO2022/033763
PCT Pub. Date: Feb. 17, 2022

(65) Prior Publication Data

US 2023/0320556 A1 Oct. 12, 2023

(30) Foreign Application Priority Data

Aug. 14, 2020 (DE) ..... 10 2020 121 394.8

(51) Int. Cl.
*A47L 13/256* (2006.01)

(52) U.S. Cl.
CPC ..... *A47L 13/256* (2013.01)

(58) Field of Classification Search
CPC ..... A47L 13/256; A47L 11/22; A47L 1/24; A47L 11/32; A47L 11/33; A47L 11/4041
See application file for complete search history.

(56) References Cited

U.S. PATENT DOCUMENTS

| | | | | |
|---|---|---|---|---|
| 2,873,465 | A * | 2/1959 | Miller | A47L 9/242 15/375 |
| 8,020,236 | B2 * | 9/2011 | Kaleta | A47L 11/4041 15/88.4 |
| 8,997,294 | B2 * | 4/2015 | Spencer | A46B 11/00 15/4 |
| 2003/0204923 | A1 | 11/2003 | Nakamura | |
| 2009/0077761 | A1 | 3/2009 | Kaleta et al. | |
| 2014/0196226 | A1 | 7/2014 | Spencer | |
| 2014/0325774 | A1 * | 11/2014 | Tawara | A47L 11/22 15/244.4 |

FOREIGN PATENT DOCUMENTS

| | | | |
|---|---|---|---|
| CN | 1454566 | A | 11/2003 |
| CN | 102240190 | A | 11/2011 |
| CN | 203693489 | U | 7/2014 |
| CN | 110352029 | A | 10/2019 |
| JP | 3162930 | U | 9/2010 |

* cited by examiner

*Primary Examiner* — Shay Karls
(74) *Attorney, Agent, or Firm* — LEYDIG, VOIT & MAYER, LTD.

(57) ABSTRACT

A cleaning device including a mop plate having a first main side and a second main side, wherein the first main side is assigned a cleaning cloth which can be fastened or is fastened to the mop plate in an exchangeable manner, wherein the mop plate is assigned a reservoir for taking up dirt particles, and wherein the cleaning cloth forms a delimiting wall of the reservoir.

9 Claims, 14 Drawing Sheets

CLEANING DEVICE

CROSS REFERENCE TO RELATED APPLICATIONS

This application is a U.S. National Phase application under 35 U.S.C. § 371 of International Application No. PCT/EP2021/068163, filed on Jul. 1, 2021, and claims benefit to German Patent Application No. DE 10 2020 121 394.8, filed on Aug. 14, 2020. The International Application was published in German on Feb. 17, 2022, as WO 2022/033763 A1 under PCT Article 21(2).

FIELD

The invention relates to a cleaning device, a mop plate, and a cleaning cloth which can be fastened or is fastened to the mop plate in an exchangeable manner.

BACKGROUND

Cleaning devices are generally known and are used both for the wet cleaning and the dry cleaning of smooth floors, for example tiled floors or parquet floors. In a configuration of the cleaning device for dry cleaning, it is mostly used for intermediate cleaning or for dusting. To this end, the mop plate has fastened to it a cleaning cloth which, after the cleaning work has been completed or after said cleaning cloth has been saturated with dirt, is removed again or exchanged for a new cleaning cloth. In this regard, it is known to form the cleaning cloth from a nonwoven material and to fasten it to the mop plate by means of a simple fastening device, for example by means of soft clips.

The cleaning device may be configured for dry cleaning. To this end, the cleaning device with the cleaning cloth fastened thereto is guided over a floor to be cleaned, wherein the cleaning cloth takes up dust and smaller particles from the floor to be cleaned. In this case, dust-like contaminants may be taken up into the matrix of the cleaning cloth, the take-up capacity for such contaminants being particularly good if the material of the cleaning cloth is porous, as is the case for example with nonwoven material. There is a problem here in that the cleaning cloth cannot take up coarser particles and these remain on the floor to be cleaned.

SUMMARY

In an embodiment, the present disclosure provides a cleaning device comprising a mop plate having a first main side and a second main side, wherein the first main side is assigned a cleaning cloth which can be fastened or is fastened to the mop plate in an exchangeable manner, wherein the mop plate is assigned a reservoir for taking up dirt particles, and wherein the cleaning cloth forms a delimiting wall of the reservoir.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
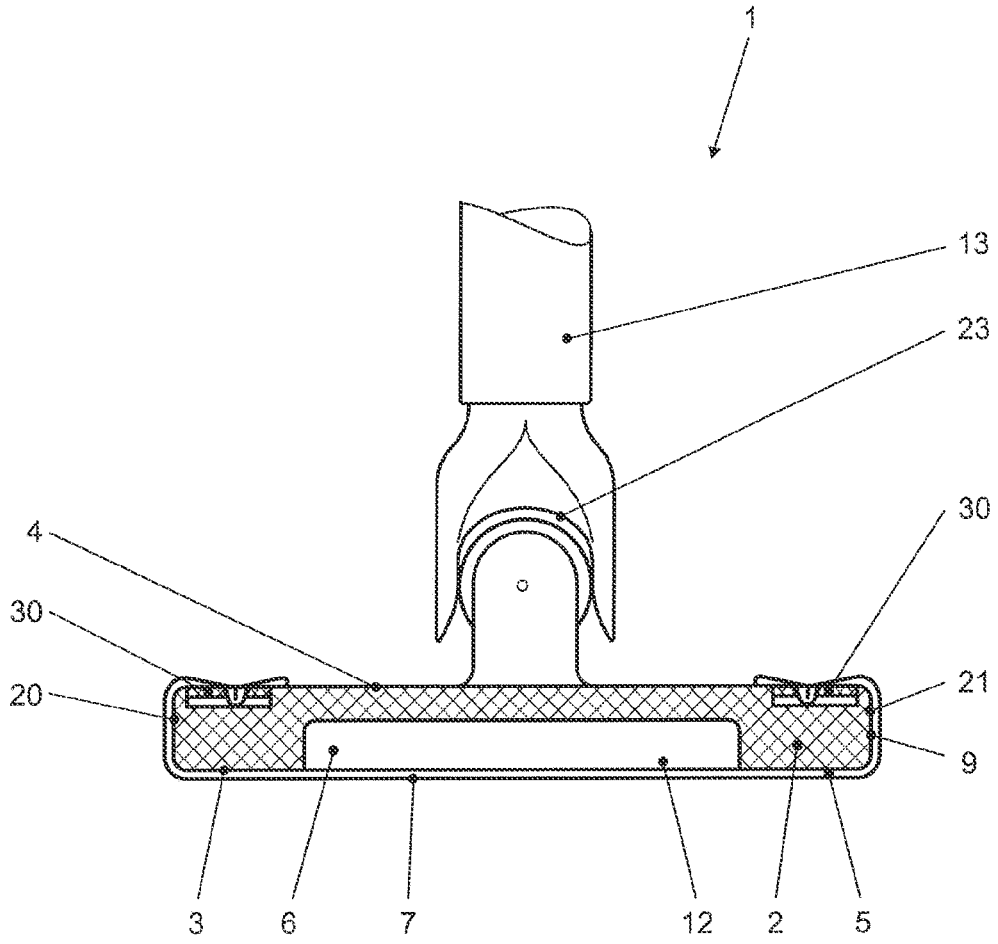
FIG. 1 illustrates a cleaning device in section.

In an embodiment, a cleaning device is provided which is configured to take up larger particles.

In an embodiment, the cleaning device comprises a mop plate having a first main side and a second main side, wherein the first main side is assigned a cleaning cloth which can be fastened or is fastened to the mop plate in an exchangeable manner, wherein the mop plate is assigned a reservoir for taking up dirt particles, wherein the cleaning cloth forms a delimiting wall of the reservoir.

According to an embodiment of the invention, the cleaning cloth has two functional surfaces. A first functional surface faces the floor to be cleaned during the intended use. According to the configuration of the cleaning cloth, the latter takes up dust and smaller particles during the cleaning operation. By contrast, larger particles are supplied to the reservoir formed in the mop plate, wherein the particles accumulate on the second side of the cleaning cloth, since the second side of the cleaning cloth forms a delimiting wall of the reservoir, wherein the delimiting wall forms the underside of the reservoir owing to the arrangement of the cleaning cloth on the first main side. In this configuration, contaminants may be removed in a particularly simple manner. Dust and smaller particles adhere to the one side of the cleaning cloth and larger particles lie on the other side of the cleaning cloth. To remove the particles, the cleaning cloth is removed from the mop plate and the cleaning cloth may either be disposed of together with the taken-up dirt or the cleaning cloth may be cleaned, for example in a machine wash.

A take-up opening may be formed from the reservoir. Dirt particles can be supplied to the reservoir via the take-up opening.

The take-up opening may lead into an edge of the mop plate. As a result, the take-up opening is particularly easy to access and the dirt particles can be reliably taken up into the reservoir.

The mop plate is preferably of rectangular configuration, wherein the take-up opening is assigned to a narrow side of the mop plate. On the one hand, this enables particularly simple fastening of the cleaning cloth. On the other hand, the take-up opening is accessible even in the case of a mounted cleaning cloth and does not cause disruption during the mopping operation.

The take-up opening may be assigned a sweeping device. The sweeping device makes it easier to take up the dirt particles into the reservoir. The sweeping device may comprise, for example, a rotatable brush which can be brought into contact with the floor to be cleaned and which conveys particles from the floor to be cleaned into the reservoir. This sweeping device, just like the take-up opening, is preferably assigned to a narrow side of the mop plate.

To form the reservoir, an aperture may be introduced into the mop plate, wherein the aperture is open toward the first main side. This ensures that the cleaning cloth forms a delimiting wall of the reservoir. Furthermore, the mop plate is particularly simple to produce, the mop plate being able to be formed, for example, from plastic and being produced by injection molding.

A handle may be able to be fastened to the second main side in an articulated manner. In this case, the joint is preferably in the form of a universal joint, which allows particularly good maneuvering of the cleaning device using the handle. The articulated attachment of the handle is preferably designed in such a way that the handle can be brought down so far that it is oriented parallel to the surface to be cleaned. As a result, the cleaning device can also reach difficult-to-reach areas, for example under items of furniture.

The cleaning cloth may be formed from a textile sheetlike structure. Such cleaning cloths are inexpensive and simple to produce. Depending on the configuration, the cleaning cloth may be configured for single use or for reuse. If the cleaning cloth is to be configured for reuse, it is advantageously designed to be able to be machine-washed.

The cleaning cloth is preferably formed from nonwoven material. In this configuration, the cleaning cloth is in the form of a disposable cloth and is disposed of together with the taken-up dirt after use.

Some configurations of the cleaning device according to embodiments of the invention are explained in more detail below on the basis of the figures. In the figures, in each case schematically:

The figures show a cleaning device 1 in the form of a flat mopping device for dry cleaning. The cleaning device 1 comprises a mop plate 2 having a first main side 3 and a second main side 4. The mop plate 2 is of rectangular configuration and has two longitudinal sides 20, 21 and two narrow sides 10, 22. An encircling edge 9 is located between the first main side 3 and the second main side 4. The mop plate 2 is formed from injection-moldable plastic.

The first main side 3 of the mop plate 2 is assigned a cleaning cloth 5, wherein the cleaning cloth covers the first main side 3 and is looped over the two longitudinal sides 20, 21 to the second main side 4. In the present configuration, the cleaning cloth 5 is in the form of a textile sheetlike structure composed of nonwoven material. To fasten the cleaning cloth 5, fastening elements 30 in the form of soft clips are arranged on the second main side 4 of the mop plate 2. The fastening elements 30 are arranged in the corner regions of the mop plate 2.

The mop plate 2 is assigned a reservoir 6 for taking up dirt particles. To form the reservoir 6, an aperture 12 is introduced into the mop plate 2, wherein the aperture 12 is open toward the first main side 3. As a result, the cleaning cloth 5 forms a delimiting wall 7 of the reservoir 6. Due to the fact that the cleaning cloth 5 is arranged below the mop plate 2 during the intended use, dirt particles taken up into the reservoir 6 accumulate on the cleaning cloth 5. After the cleaning cloth 5 has been removed, the dirt particles may be disposed of in a loss-free manner, for example by folding of the cleaning cloth 5.

To take up the dirt particles into the reservoir 6, a take-up opening 8 is formed from the reservoir 6, said take-up opening leading into an edge 9, which is arranged on the narrow side 10, of the mop plate 2. In the exemplary embodiment illustrated, the take-up opening 8 is arranged in the region of the edge 9, between the mop plate 2 and the sweeping device 11.

A handle 13 is fastened to the second main side 4 of the mop plate 2 in an articulated manner by means of a universal joint 23. The universal joint 23 is configured such that the handle 13 can be tilted so far during the cleaning work that the handle 13 lies flat against the mop plate 2 and is oriented substantially parallel to the floor to be cleaned.

The take-up opening 8 is assigned a sweeping device 11. This sweeping device 11, just like the take-up opening 8, is arranged on the narrow side 10 of the mop plate 2. This sweeping device 11 is fastened to the mop plate 2 in such a way that the sweeping device can be moved between a sweeping position 14 and a rest position 15. The sweeping device 11 has a rotatably mounted sweeping element 16 which is in the form of a sweeping roller and which in the sweeping position 14 comes into contact with the floor to be cleaned. In the configuration illustrated by way of example, the sweeping element 16 is formed from an elastic foam.

In order to set the sweeping element 16 in rotation, the sweeping device 11 is provided with a drive device in the form of a drive wheel 24. The drive wheel 24 is in the form of a friction wheel. If the sweeping device 11 is in the sweeping position 14, the drive wheel 24 lies against the floor to be cleaned (or another area to be cleaned). The drive wheel 24 is formed, at least at the outer circumference, from elastomeric material and lies with preload against the floor to be cleaned. It is, however, also possible to use other suitable materials for the drive wheel 24. If the cleaning device 1 is pushed via the narrow side 10, the drive wheel 24 moves and thus drives the sweeping element 16. The rotational speed of the sweeping element 16 is determined in this case by a gearing stage 25 which is arranged between the drive wheel 24 and the sweeping element 16.

The sweeping device 11 is also provided with a take-up bevel 26 which leads into a cleaning lip 27. This allows contaminants to be taken up in a particularly effective manner and supplied to the reservoir 6. In the sweeping position 14, the cleaning lip 27 faces the floor to be cleaned. The take-up bevel 26 and the sweeping element 16 are of at least partially congruent configuration, and there is only a narrow gap between the sweeping element 16 and the take-up bevel 26. The gap finally leads into the take-up opening 8 in the reservoir 6.

In the rest position 15, the sweeping element 16 is spaced apart from the floor to be cleaned. In the rest position 15, this sweeping element 16 is partially retracted into the mop plate 2. A cover 28, which covers the sweeping device 11, is arranged on the second main side 4 of the mop plate 2.

The mop plate 2 is assigned an actuating device 17 which is operatively connected to the sweeping device 11, wherein actuation of the actuating device 17 causes the sweeping device 11 to move from the rest position 15 into the sweeping position 14 and vice versa. To this end, the actuating device 17 is equipped with a pedal 18. The actuating device 17 is also equipped with a spring element 19, which automatically moves the sweeping device 11 from the rest position 15 into the sweeping position 14 after actuation of the actuating device 17. Pushing of the pedal 18 into the mop plate 2 unlocks the actuating device 17, and the spring element 19 causes the sweeping device 11 to move from the rest position 15 into the sweeping position 14. In this case, the pedal 18 pivots away from the mop plate 2 and remains in a folded-out position in the sweeping position 14. In order to move the sweeping device 11 from the sweeping position 14 back into the rest position 15, the pedal 18 is folded back in the direction of the mop plate 2, wherein the sweeping device 11 moves from the sweeping position 14 into the rest position 15 counter to the force of the spring element 19.

FIG. 1 shows the above-described cleaning device 1 in section. It can be seen here that the reservoir 6 is realized by an aperture 12 which is introduced into the first main side 3 of the mop plate 2. The cleaning cloth 5 forms, by way of the side facing the mop plate 2, a delimiting wall 7 of the reservoir 6.

Figure 2:
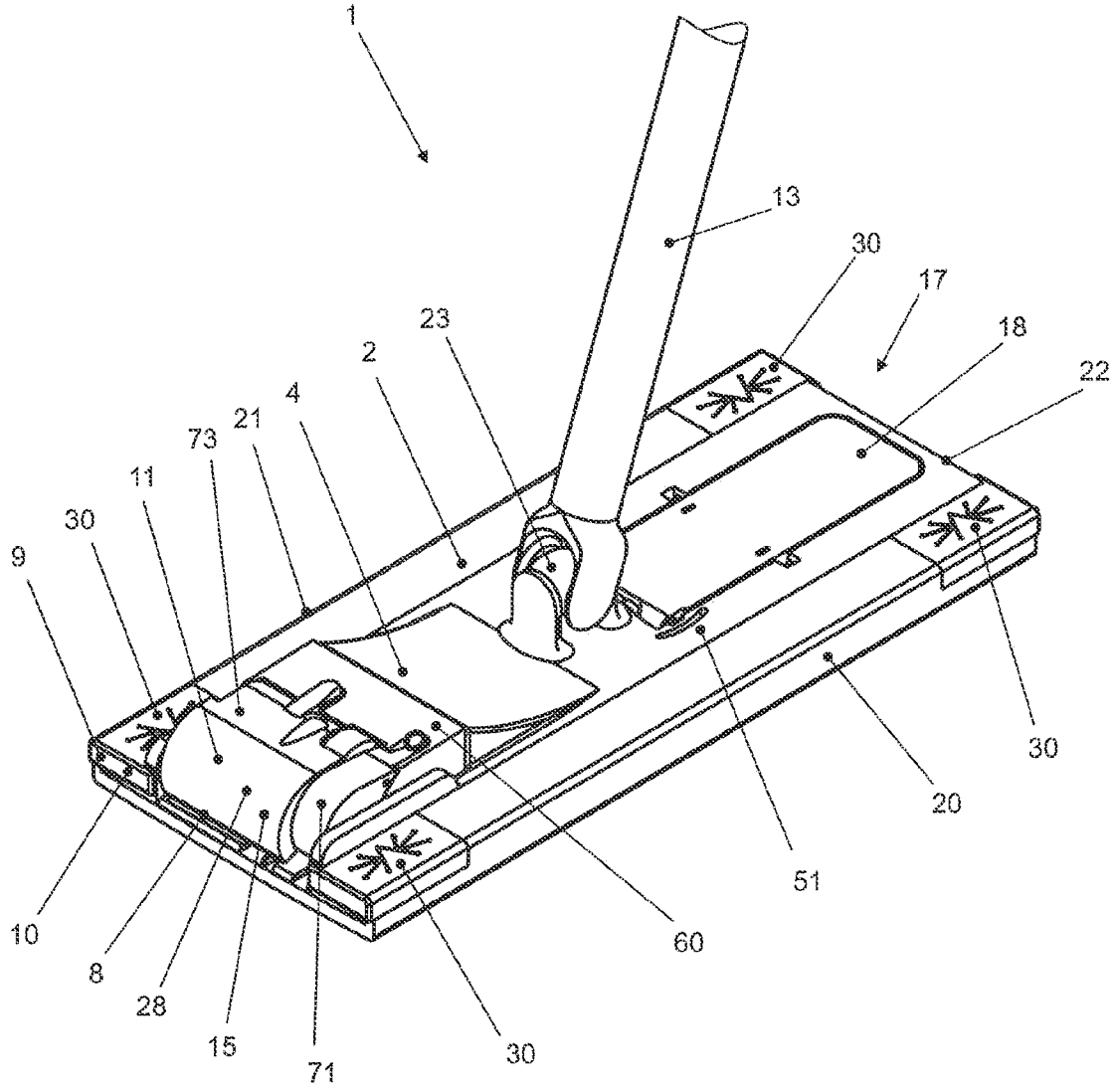
FIG. 2 illustrates a perspective illustration of the cleaning device with the sweeping device in the rest position.

FIG. 2 shows a perspective illustration of the cleaning device 1. In the configuration according to FIG. 2, the sweeping device 11 of the cleaning device 1 is in the rest position 15 and is partially retracted into the mop plate 2. If the sweeping device 11 is in the rest position, the cleaning device 1 can be guided in mopping fashion over the floor to be cleaned.

Figure 3:
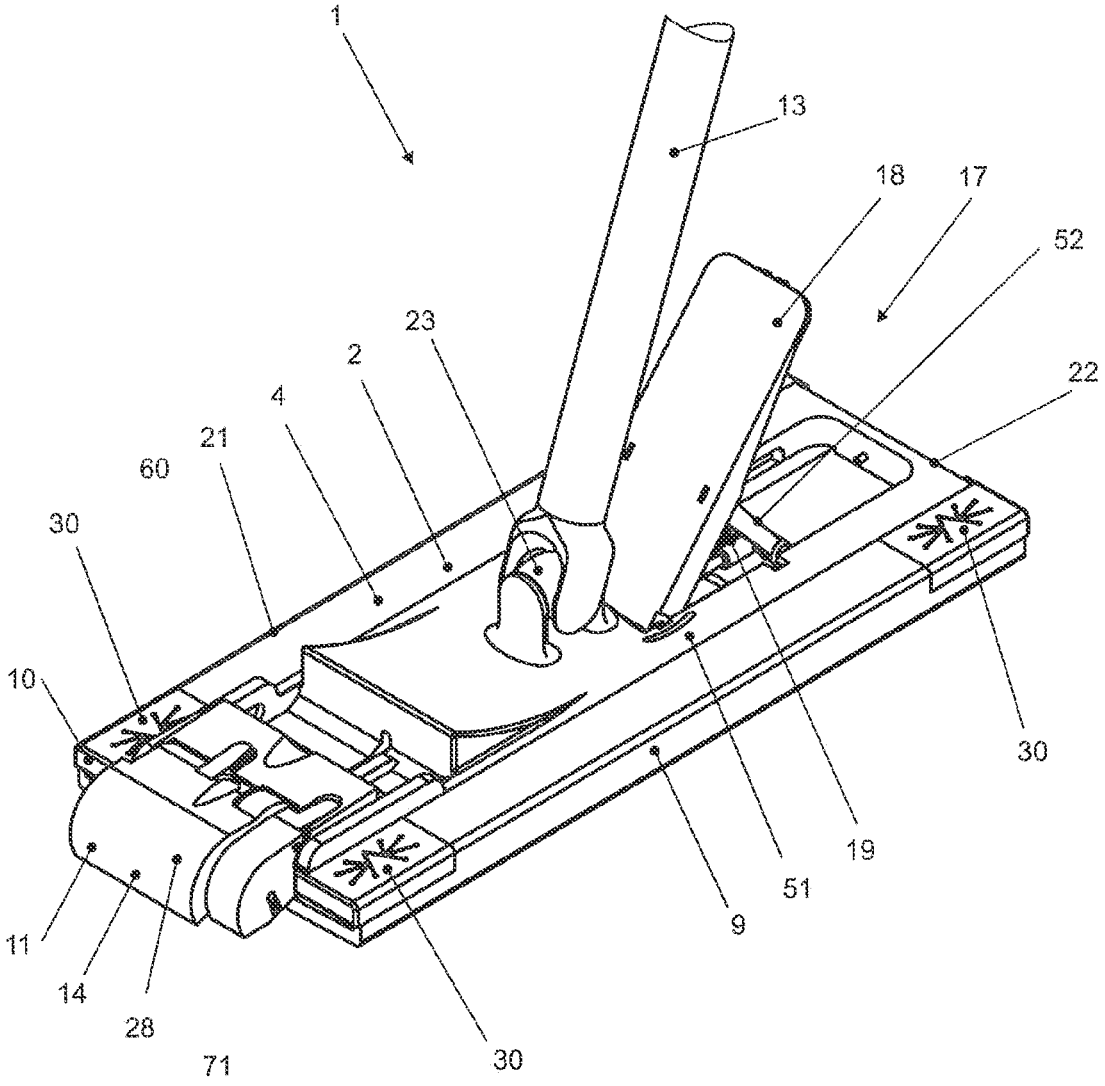
FIG. 3 illustrates a perspective illustration of the cleaning device with the sweeping device in the sweeping position.

FIG. 3 shows a perspective illustration of the cleaning device 1, the sweeping device 11 being in the sweeping position 14. In this position, the sweeping element 16 and the cleaning lip 27 come into contact with the floor to be cleaned. The pedal 18 of the actuating device 17 projects from the mop plate 2.

Figure 4:
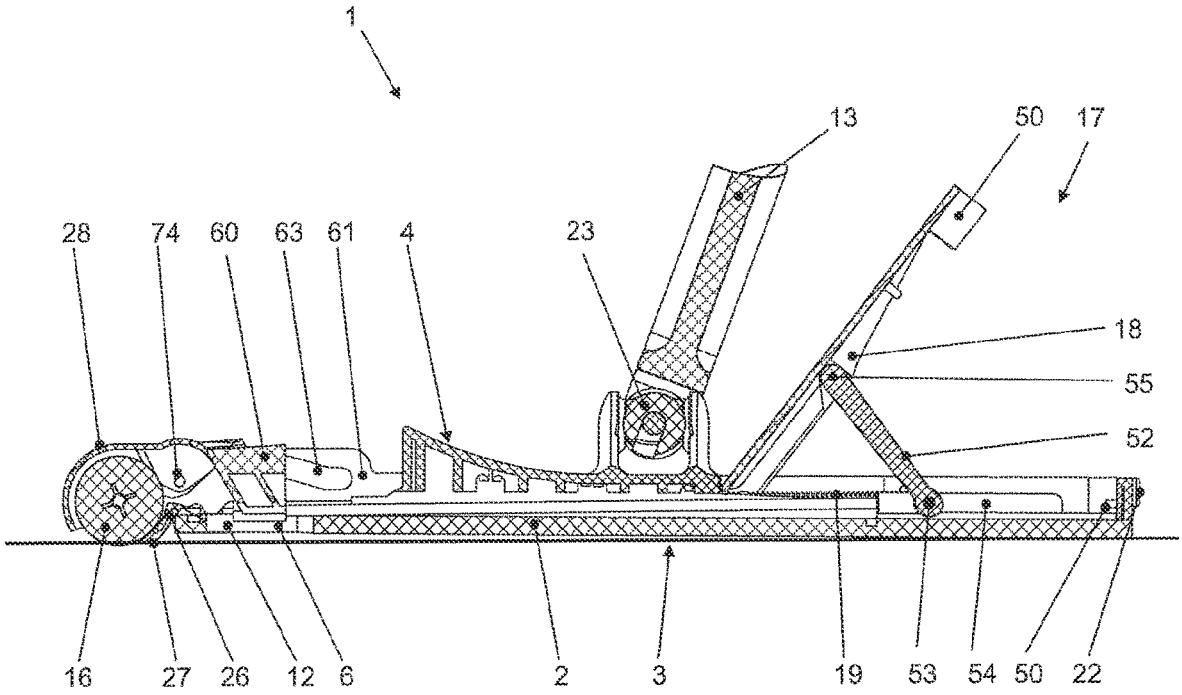
FIG. 4 illustrates the cleaning device from FIG. 3 in section through the sweeping element.
Figure 5:
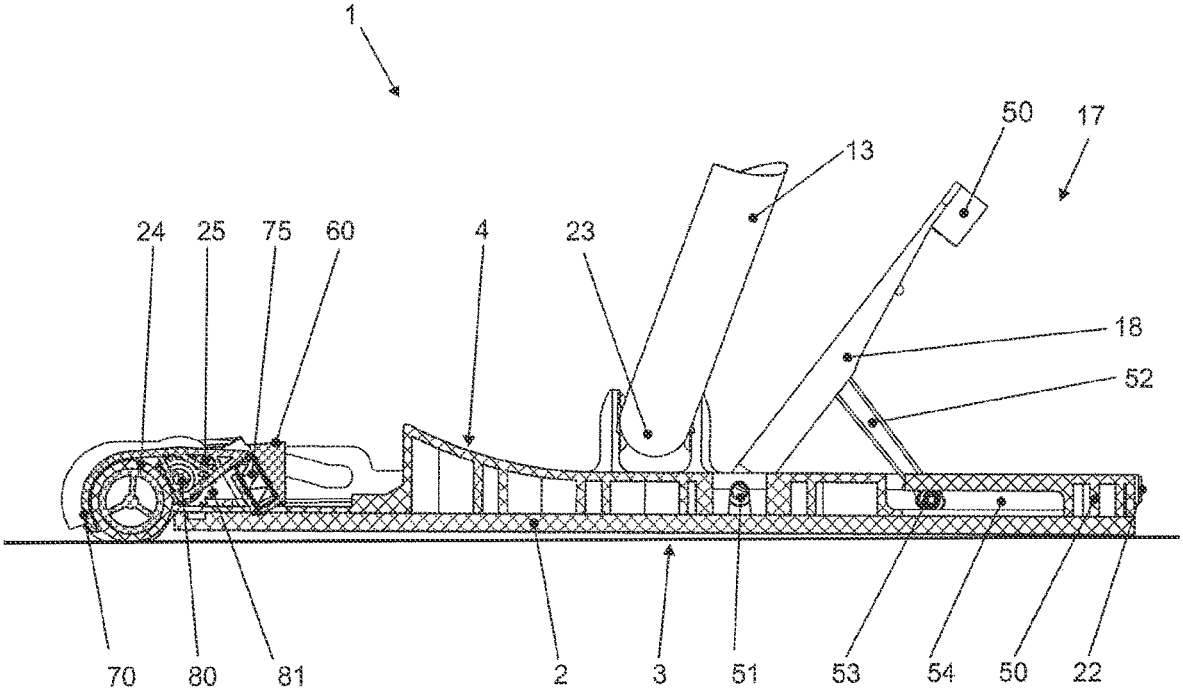
FIG. 5 illustrates the cleaning device from FIG. 3 in section through the drive wheel.

FIGS. 4 and 5 each show the cleaning device 1 according to FIG. 3 in section. In FIG. 4, the section is selected such that the sweeping element 16 can be seen, whereas in FIG. 5, the section runs through the drive wheel.

FIGS. 4 and 5 also illustrate that the pedal 18 is in the form of a one-armed lever which can be pivoted about the axis of rotation 51. In the exemplary embodiment illustrated, the pedal 18 is provided with a push-push lock 50. A single push downward on the pedal 28 in the vicinity of the free end thereof is enough for unlocking. If the pedal 18 is subsequently folded downward again, the pedal 18 is locked by a further push.

The pedal 18 is connected, by means of a strut 52, to a holding body 53 which can be displaced linearly in a guide 54 attached to the mop plate 2. The guide 54 comprises two slots, which are formed in the mop plate on both sides of the holding body 53. In this way, the pivoting movement of the pedal 18 is transformed into a translational movement of the holding body 53, which can be moved back and forth in the guide 54 by way of the pedal. The strut 52 is connected to the lever 18 so as to be movable about the axis of rotation 55. One end of the spring element 19 is also fastened to the holding body 53, in order to move the lever 18 away from the mop plate 2 after the lock 50 has been released and to bring the sweeping device 11 into the sweeping position 15. The other end of the spring element 19 is fastened to the mop plate 2.

Figure 6:
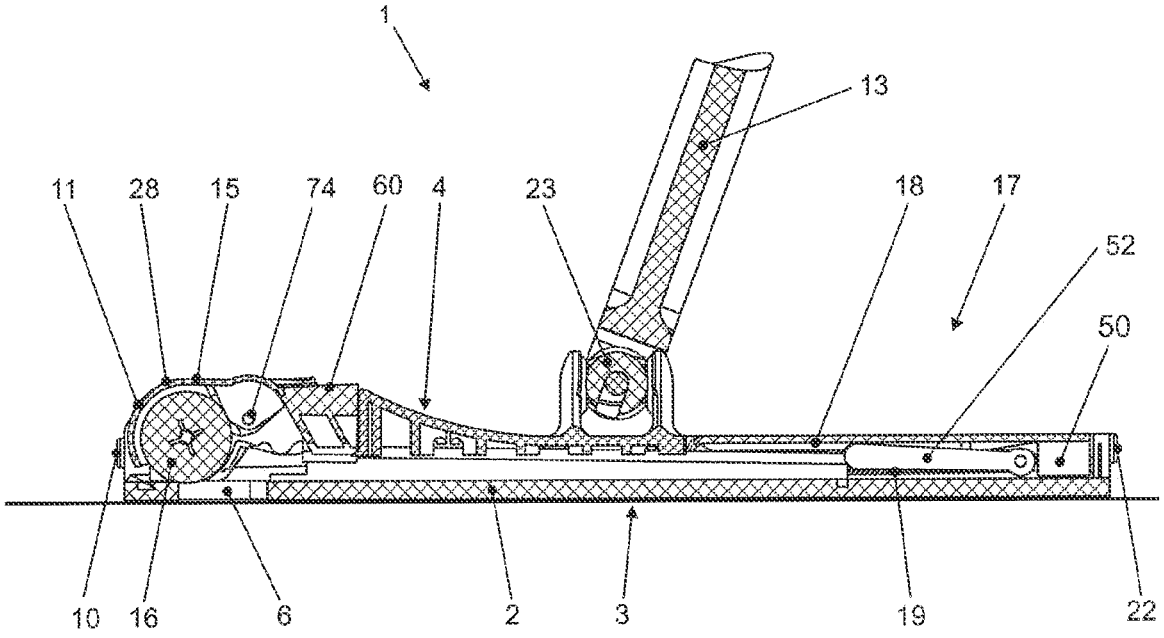
FIG. 6 illustrates the cleaning device from FIG. 2 in section with the sweeping device in the rest position.

FIG. 6 shows the cleaning device 1 according to FIG. 2. The sweeping device 11 is in the rest position 15 and is partially retracted into the mop plate 2. Furthermore, the sweeping element 16 is spaced apart from the floor to be cleaned. The pedal 18 of the actuating device 17 lies flat against the mop plate 2, wherein an aperture, which is configured congruently with respect to the pedal 18 and into which the pedal 18 is recessed in the rest position 15, is introduced into the mop plate 2.

Figure 7:
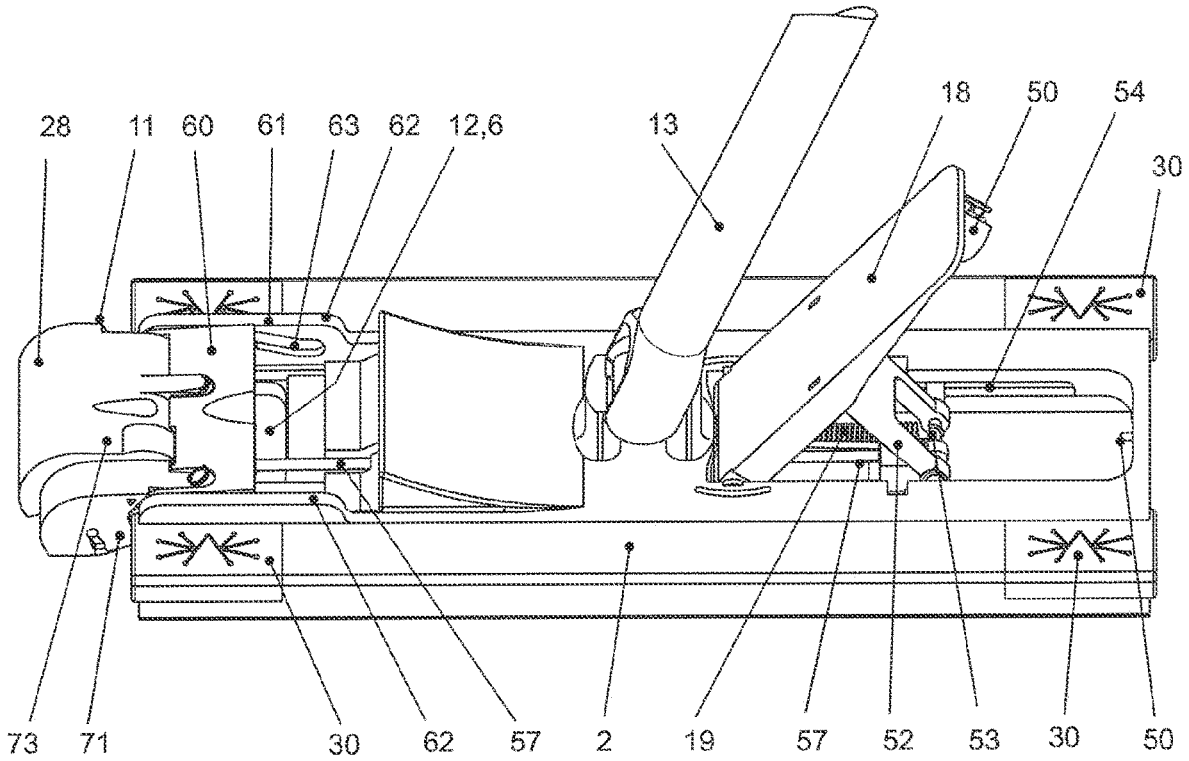
FIG. 7 illustrates a further perspective illustration of the cleaning device from FIG. 3 from the side.

FIG. 7 shows the cleaning device 1 with the sweeping device 11 in the sweeping position. Here, the pedal 18 is in the folded-out position. As a result, the holding body 53 is moved in the guide 54 toward the first narrow side 10. The movement is transmitted to the sweeping device 11 by way of an actuating means 57 in the form of a rod. This movement is effected under the action of the spring 19 which is connected to the pedal 18 by means of the holding body 53.

FIG. 7 also shows that the sweeping device 11 comprises a displaceable body 60 in the form of a movable carriage. In this case, the sweeping device 11 is assigned a slotted guide 61 which is arranged on the mop plate 2. The slotted guide 61 comprises guide elements 62 which are arranged on both sides of the displaceable body 60 and which each have a guide slot 63. Guide cams 64, which are arranged on both sides on the displaceable body 60 (cf. FIG. 8), engage in the guide slots 63. The slotted guide 61 is configured such that it enables a displacement of the sweeping device 11 along the mop plate 2. What this firstly achieves is that the sweeping device 11 protrudes laterally beyond the narrow side 10 of the mop plate 2 in the sweeping position 14, whereas it does not protrude beyond the periphery of the mop plate 2 in the rest position 15 (cf. FIG. 2). To this end, the guide slot 63 has a first portion 65 which runs parallel to the plane of the mop plate 2. This can also be readily seen in FIG. 12, which illustrates a detail of the mop plate 2 with the slotted guide 61, but without the sweeping device 11.

The slotted guide 61 is also configured in such a way that it enables a displacement of the sweeping device 11 transversely with respect to the mop plate 2, with the result that the sweeping device 11 protrudes in relation to the first main side 3 of the mop plate 2 in the sweeping position 14. This is achieved in that the guide slot 63 of the slotted guide 61 has a second portion 66 which runs, proceeding from the portion 65, transversely with respect to the plane of the mop plate 2, toward the first main side 3. The portion 66 is arranged on that side of the portion 65 which faces the narrow side 10.

The slotted guide 61 also has a third portion 67 of the guide slot 63, in which the guide slot 63 runs transversely with respect to the plane of the mop plate 2. The portion 67 is arranged on that side of the portion 65 which faces away from the narrow side 10. The third portion 67 makes it possible for the sweeping device to move toward the mop plate 2, such that said sweeping device, in the rest position 15, is partially accommodated in a cutout formed in the mop plate 2.

Figure 8:
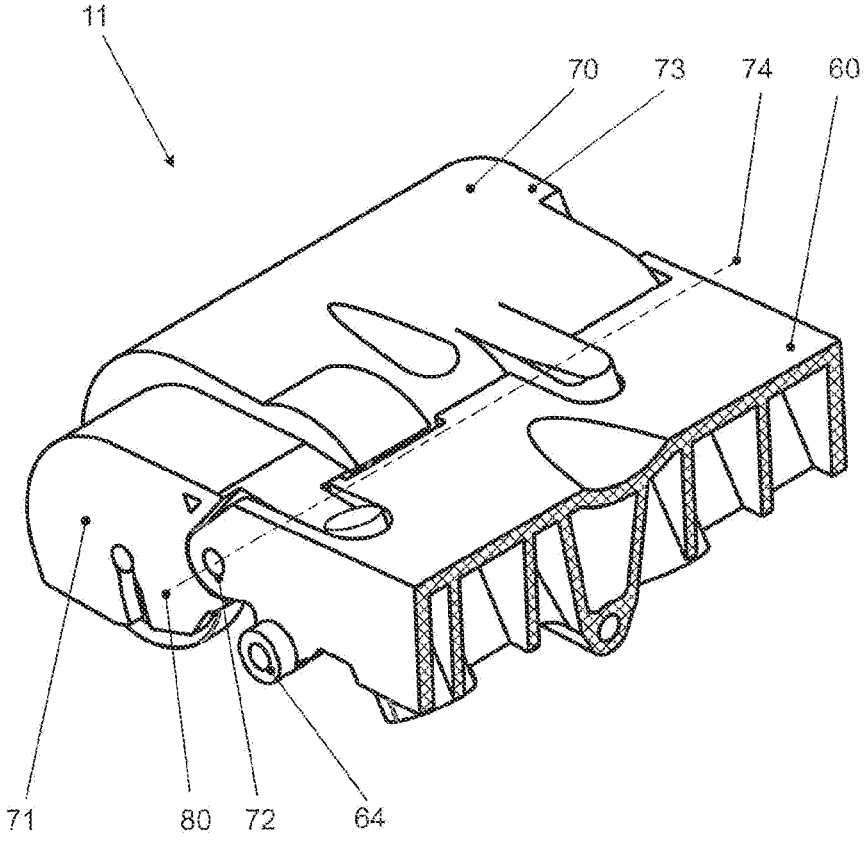
FIG. 8 illustrates a perspective illustration of the sweeping device of the cleaning device from FIG. 7 obliquely from above.
Figure 9:
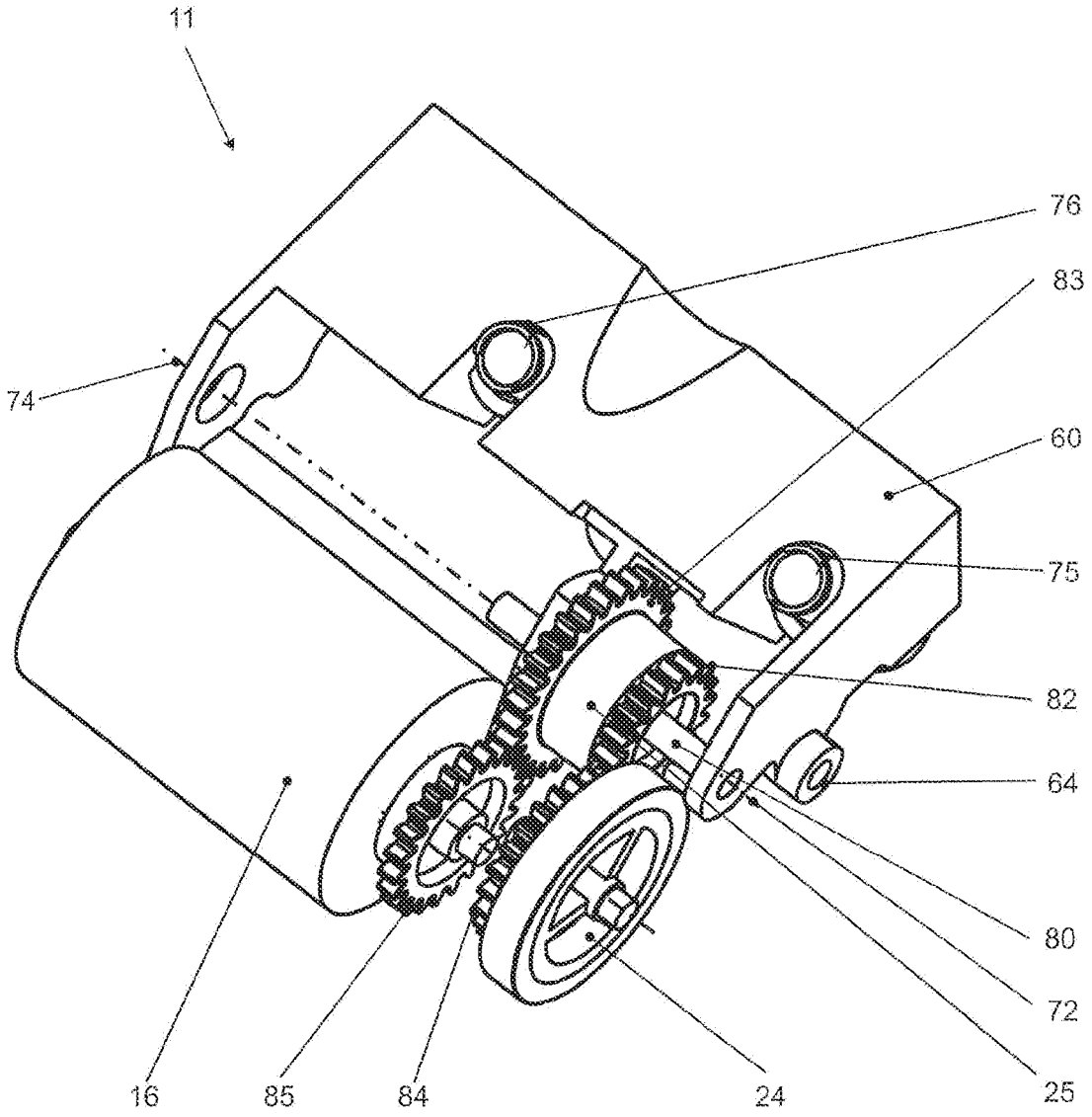
FIG. 9 illustrates a perspective illustration of the sweeping device from FIG. 8 without a cover.
Figure 10:
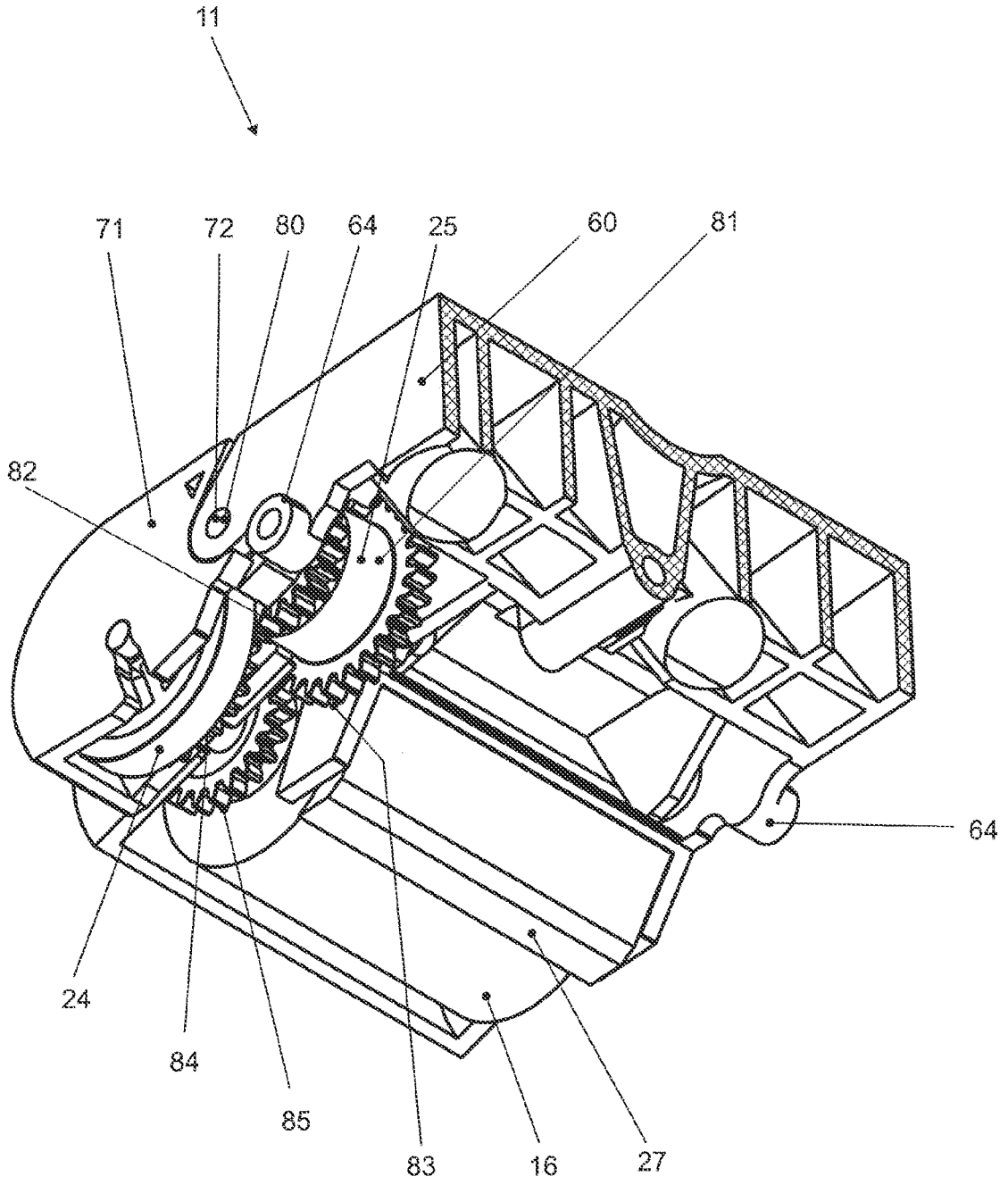
FIG. 10 illustrates a perspective illustration of the sweeping device from FIG. 8 from below.

FIGS. 8 to 10 show further details of the sweeping device 11. FIG. 8 shows the sweeping device 11 with the cover 28, whereas the sweeping device 11 is illustrated without a cover in FIG. 9, in order to more clearly illustrate the drive wheel 24 in the form of a friction wheel, the sweeping element 16 in the form of a sweeping roller, and the gearing stage 25.

The figures show that the sweeping device 11 has a drive wheel suspension 71 which is arranged on the mop plate 2 so as to be movable about a first pivot axis 72.

The sweeping device 11 further comprises a sweeping element suspension 73 which is arranged on the mop plate 2 so as to be movable about a second pivot axis 74. In the exemplary embodiment illustrated, the first and the second pivot axis 72, 74 are arranged coaxially.

The drive wheel suspension 71 comprises a spring 75 which preloads the drive wheel 24 toward the surface to be cleaned. The sweeping element suspension 73 comprises a spring 76 which preloads the sweeping roller 16 toward the surface to be cleaned. The drive wheel suspension 71 and the sweeping element suspension 73 are independent of one another, such that the sweeping element 16 and the drive wheel 24 can be pivoted independently of one another about the first and, respectively, the second pivot axis 72, 74.

FIG. 9 illustrates how the sweeping element 16 can be set into a rotating movement by the drive wheel 24 via the gearing stage 25. When the mop plate 2 is moving along a surface to be cleaned, the drive wheel 24 can be set in rotation owing to the contact with the surface to be cleaned. The gearing stage 25 is provided for this purpose. Said gearing stage comprises a gearwheel 81 which can be rotated about a gear axis of rotation 80. This gear axis of rotation 80 is arranged coaxially with the first pivot axis 72 and the second pivot axis 74. The gearwheel 81 comprises a first toothed ring 82 and a second toothed ring 83. The first toothed ring 82 is in engagement with the drive wheel toothed ring 84, which is provided on the drive wheel 24. The second toothed ring 83 is in engagement with the sweeping element toothed ring 85, which is provided on the sweeping element 16. In this way, a rotating movement of the drive wheel 24 can be transformed into a rotating movement of the sweeping element 16. In this case, a transmission ratio is achieved by way of the gearing stage 25, with the result that the rotational speed of the rotatable sweeping element 16 differs from the rotational speed of the drive wheel 24. In the illustrated example, the rotational speed of the sweeping element 16 is greater than the rotational speed of the drive wheel 24. This is achieved in that the first toothed ring 82 has a smaller number of teeth than the drive wheel toothed ring 84, and in that the second toothed ring 83 has a greater number of teeth than the sweeping element toothed ring 85.

FIG. 10 shows the sweeping device 11 from below. Here, it is readily possible to see how the cleaning lip 27 is arranged along the sweeping element 16.

Figure 11:
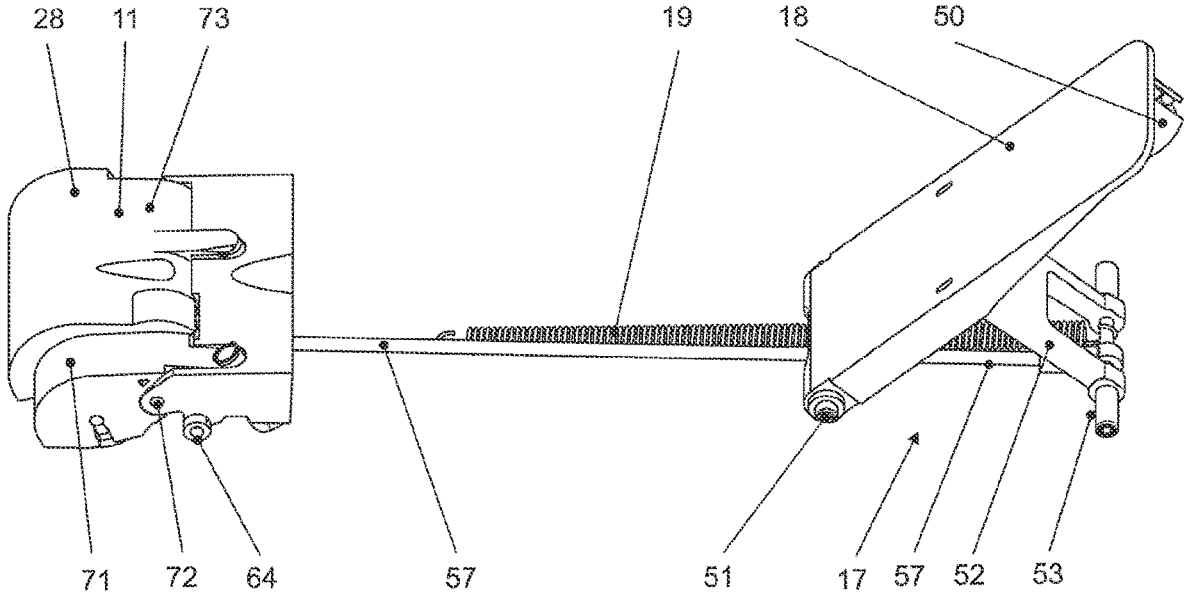
FIG. 11 illustrates a perspective illustration of the sweeping device of the cleaning device from FIG. 7 with the pedal drive.

FIG. 11 shows the sweeping device 11 and the pedal 18, further elements of the cleaning device having been omitted. Also illustrated are the elements which are used to transmit the movement of the pedal 18 to the sweeping device 11. In particular, it can be seen that, in this regard, the holding body 53 is connected to the carriage of the sweeping device 11 by way of an actuating means 57 in the form of a rod. FIG. 11 also shows the arrangement of the spring element 19, one end of which is fastened to the holding body 53.

Figure 12:
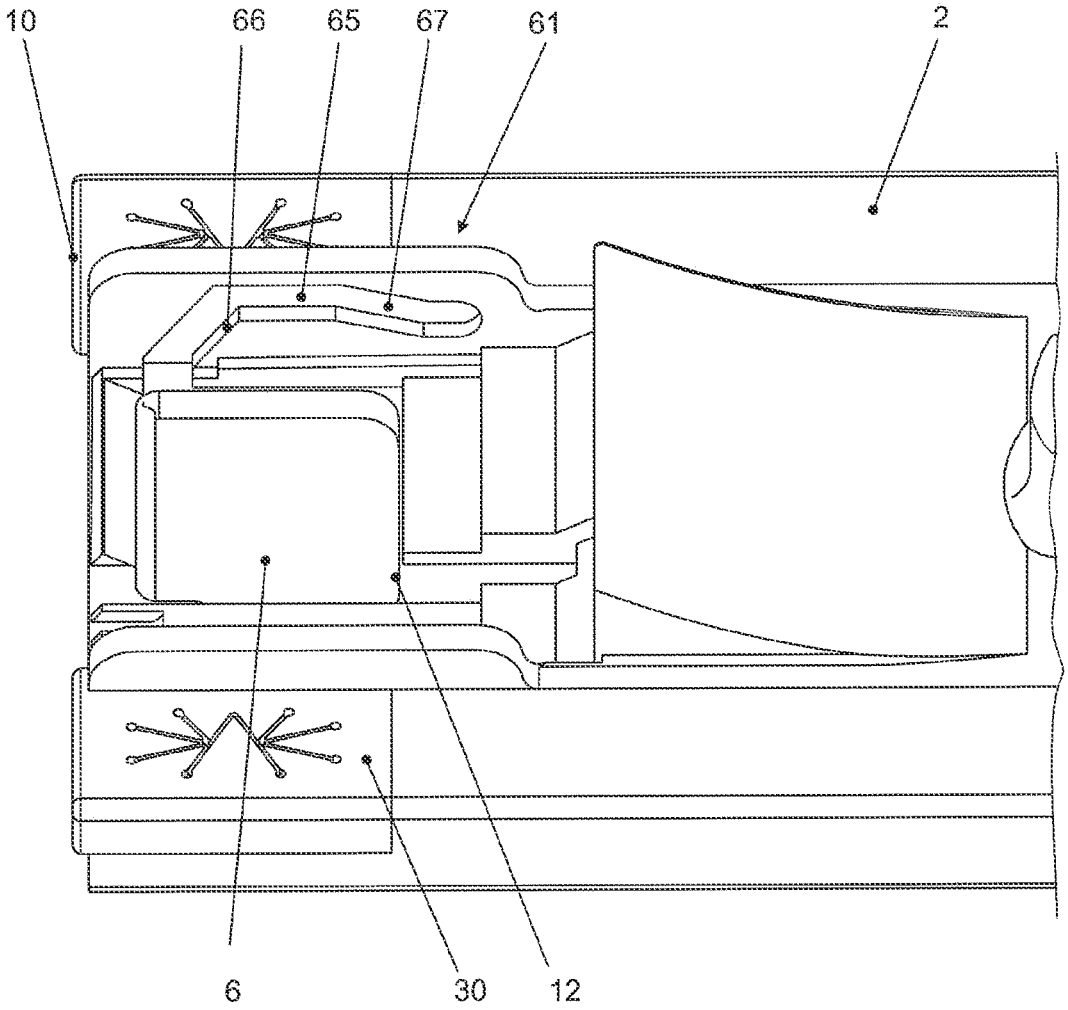
FIG. 12 illustrates a detail of the mop plate of the cleaning device from FIG. 7.

FIG. 12 shows the mop plate 2 without the sweeping device 11. The slotted guide 61 for the sweeping device 11 can be readily seen here. FIG. 12 also shows the reservoir 6 formed in the mop plate 2.

Figure 13:
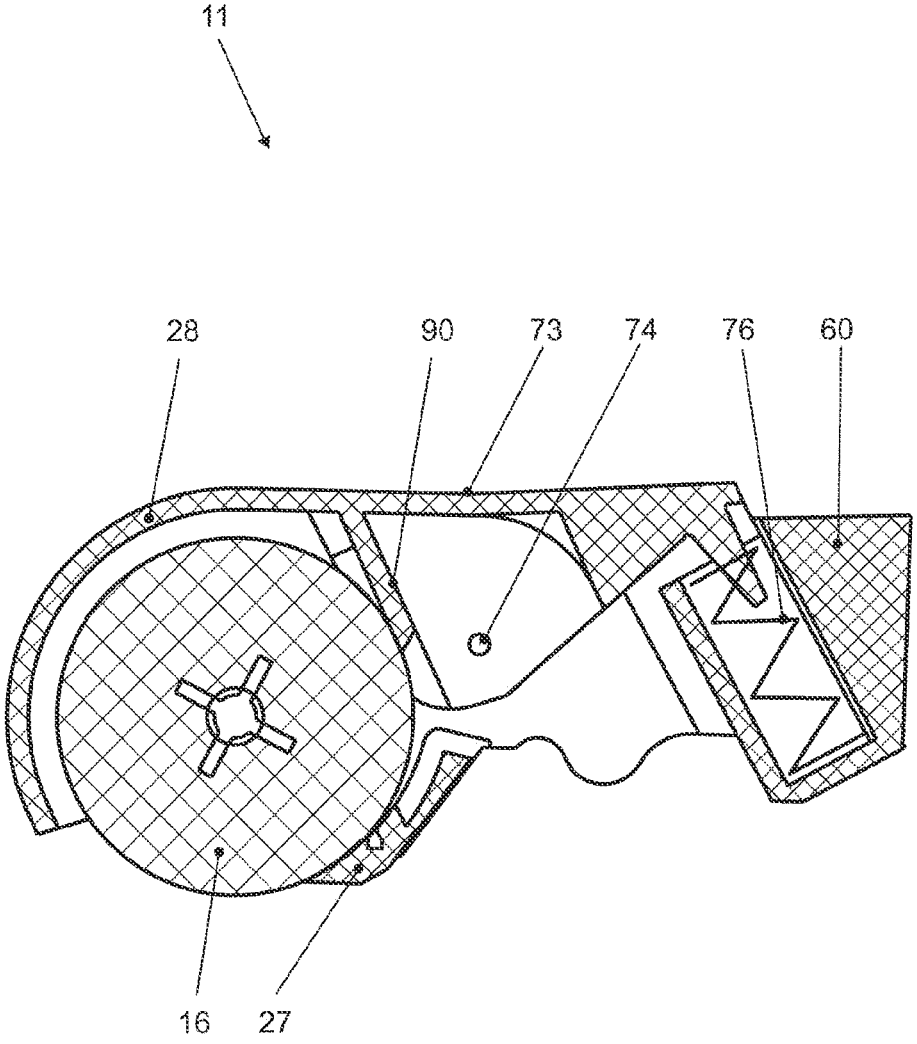
FIG. 13 illustrates a sectional illustration through the sweeping element suspension of the cleaning device from FIG. 1.

In addition to a cross section through the sweeping element 16, FIG. 13 also shows the arrangement of the cleaning lip 27 assigned to the sweeping element 16. The sweeping element suspension 73 with the associated spring 76 is also illustrated.

FIG. 13 also shows that the sweeping device 11 has a scraper 90 which lies against the sweeping element 16. Said scraper makes it possible to detach contaminants adhering to the sweeping element 16, such that these can be collected in the reservoir 6. The scraper 90 is arranged tangentially with respect to the roller-like sweeping element 16.

Figure 14:
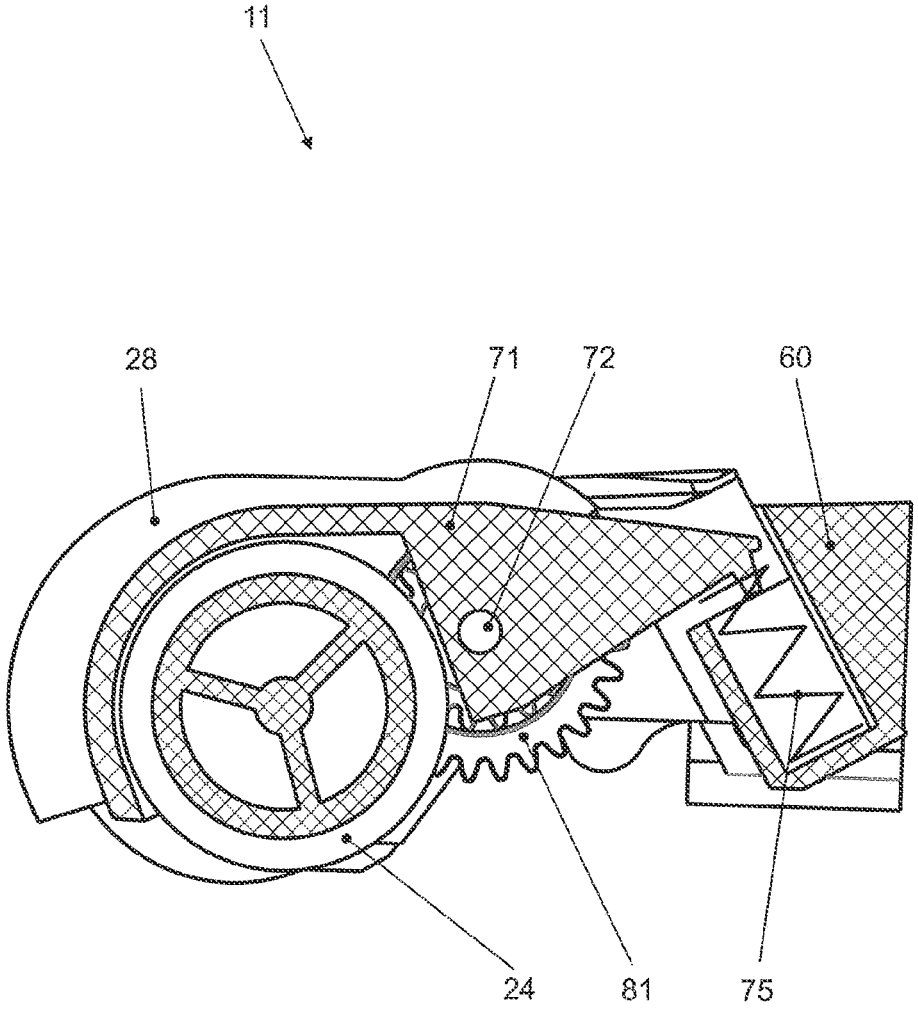
FIG. 14 illustrates a sectional illustration through the drive wheel suspension of the cleaning device from FIG. 1.

FIG. 14 shows a cross section through the drive wheel suspension 71 with the drive wheel 24 and the associated spring 75.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning device, comprising:

a mop plate having a first main side and a second main side, wherein the first main side is assigned a cleaning cloth which can be fastened or is fastened to the mop plate in an exchangeable manner, wherein the mop plate is assigned a reservoir for taking up dirt particles, wherein the cleaning cloth forms a delimiting wall of the reservoir, wherein the mop plate is of a rectangular configuration, wherein a take-up opening is assigned to a narrow side of the mop plate, and wherein the take-up opening is formed from the reservoir.

2. The cleaning device as claimed in claim 1, wherein the take-up opening leads into an edge of the mop plate.

3. The cleaning device as claimed in claim 1, wherein the take-up opening is assigned a sweeping device.

4. The cleaning device as claimed in claim 3, wherein the sweeping device is assigned a drive wheel.

5. The cleaning device as claimed in claim 3, wherein the sweeping device is assigned a take-up bevel that directs into a cleaning lip.

6. The cleaning device as claimed in claim 1, wherein the mop plate includes an aperture to form the reservoir, and wherein the aperture is open toward the first main side.

7. The cleaning device as claimed in claim 1, wherein a handle is fastened to the second main side in an articulated configuration.

8. The cleaning device as claimed in claim 1, wherein the cleaning cloth is formed from a textile sheetlike structure.

9. The cleaning device as claimed in claim 1, wherein the cleaning cloth is formed from nonwoven material.

* * * * *